US008727843B2

(12) United States Patent
McReynolds

(10) Patent No.: US 8,727,843 B2
(45) Date of Patent: May 20, 2014

(54) SELF-POWERED FLUID CONTROL APPARATUS

(75) Inventor: Alan McReynolds, Los Altos, CA (US)

(73) Assignee: Hewlett-Packard Development Company, L.P., Houton, TX (US)

( * ) Notice: Subject to any disclaimer, the term of this patent is extended or adjusted under 35 U.S.C. 154(b) by 684 days.

(21) Appl. No.: 12/829,715

(22) Filed: Jul. 2, 2010

(65) Prior Publication Data

US 2012/0003918 A1 Jan. 5, 2012

(51) Int. Cl.
*H05K 5/00* (2006.01)

(52) U.S. Cl.
USPC ..... 454/184; 454/290; 454/313

(58) Field of Classification Search
USPC ..... 62/259.2; 454/184, 258, 290, 313
See application file for complete search history.

(56) References Cited

U.S. PATENT DOCUMENTS 3,817,452 A * 6/1974 Dean, Jr. ..... 236/49.4
4,186,876 A * 2/1980 Clark et al. ..... 236/49.4
4,672,206 A * 6/1987 Suzuki et al. ..... 250/342
5,117,900 A * 6/1992 Cox ..... 165/53
5,180,333 A * 1/1993 Shyu ..... 454/319
5,230,466 A * 7/1993 Moriya et al. ..... 236/44 A
5,251,815 A * 10/1993 Foye ..... 236/49.3
5,346,426 A * 9/1994 Kronfalt ..... 454/66
5,348,078 A * 9/1994 Dushane et al. ..... 165/209
5,364,304 A * 11/1994 Hampton ..... 454/258
5,623,259 A * 4/1997 Giangardella ..... 340/932.2
6,364,211 B1 * 4/2002 Saleh ..... 236/49.3
6,659,359 B2 * 12/2003 Kwak ..... 236/49.3
6,694,759 B1 * 2/2004 Bash et al. ..... 62/180
6,747,872 B1 * 6/2004 Patel et al. ..... 361/695
6,981,383 B2 * 1/2006 Shah et al. ..... 62/129
7,347,058 B2 * 3/2008 Malone et al. ..... 62/259.2
7,463,950 B1 * 12/2008 Brey et al. ..... 700/299
7,945,973 B2 * 5/2011 Khorshid ..... 4/623
8,033,479 B2 * 10/2011 Kates ..... 236/1 B
8,348,732 B2 * 1/2013 Aronstam et al. ..... 454/256
2002/0058473 A1 * 5/2002 Park ..... 454/258
2004/0166797 A1 * 8/2004 Thrasher et al. ..... 454/290
2004/0198214 A1 * 10/2004 Karidis et al. ..... 454/186
2004/0206101 A1 * 10/2004 Bash et al. ..... 62/180
2005/0075065 A1 * 4/2005 Nair ..... 454/186
2005/0266792 A1 * 12/2005 Rimmer et al. ..... 454/290
2006/0071089 A1 * 4/2006 Kates ..... 236/94
2006/0286918 A1 * 12/2006 Vargas ..... 454/155
2007/0125107 A1 * 6/2007 Beam ..... 62/186
2009/0149123 A1 * 6/2009 Blagg ..... 454/258
2009/0293518 A1 * 12/2009 Bettella ..... 62/186

(Continued)

FOREIGN PATENT DOCUMENTS

WO WO 2008156741 12/2008

*Primary Examiner* — Steven B McAllister
*Assistant Examiner* — Jonathan Cotov

(57) ABSTRACT

A self-powered fluid control apparatus includes a casing having an interior section defined by a plurality of walls, at least one louver positioned within the interior section and extending along a plane, and a fluid flow-driven electrical generator positioned within the interior section substantially along the plane, the fluid flow-driven electrical generator being configured to generate an output current when sufficiently driven by a fluid flow stream through the generator. The flow control apparatus also includes a motor coupled to the at least one louver and a controller configured to generate and provide the control signal to the motor, in which the motor and the controller are powered solely by the output current generated by the fluid flow-driven electrical generator.

20 Claims, 4 Drawing Sheets

(56) References Cited

U.S. PATENT DOCUMENTS

2010/0311317 A1* 12/2010 Mcreynolds et al. ..... 454/256
2011/0269389 A1* 11/2011 Scharf et al. ..... 454/258
2012/0156981 A1* 6/2012 Curtin et al. ..... 454/184

* cited by examiner

SELF-POWERED FLUID CONTROL APPARATUS

BACKGROUND

Computer rooms, or data centers, are known to be built with raised floors. The under floor volume is pressurized with a cooling fluid, often chilled air. Where cooling is needed, the cooling fluid blows upwards through vented floor tiles, which are often mechanically constructed devices, which contain fixed venting (covering a known percentage of their surface area) or are designed with adjustable louvers or sliding apertures to allow more or less of the cooling fluid to flow through the tile. The cooling fluid flows through the vented floor tiles and is circulated throughout the computer systems in the computer rooms, causing a cooling effect.

The need for the cooling fluid varies in the short term as load gets passed around the room and in the long term as more computer systems are added to the room or racks are vacated. As such, some types of vented floor tiles are known to incorporate servo mechanisms to adjust louvers contained therein, under computer control, to the desired angle in order to vary the volume flow rate of the cooling fluid. These types of vented floor tiles are often difficult to install because they typically require wiring for power and data communications. Thus, for instance, in a relatively large computer room having a large number of automated floor tiles, the time and labor required to install the automated floor tiles often becomes exorbitantly high.

A number of approaches have been devised to eliminate the need for the wiring to the automated floor tiles. For instance, U.S. Patent Application Publication No. 2006/0286918 to Vargas, the disclosure of which is hereby incorporated by reference in its entirety, describes a self-powered automated air vent that includes an airflow-driven generator mounted on or near the vent tile. More particularly, Vargas discloses that the airflow-driven generator is mounted directly to the vent frame with the air vanes mounted directly behind the louvers. Thus, in Vargas, when the air vanes are closed, no air flows through the airflow-driven generator and thus, no electrical current is generated. As such, the automated air vent of Vargas requires that an energy storage be included in the air vent assembly to provide sufficient power to move the air vanes from a completely closed positioned to an open position. The requirement of the energy storage increases the size and cost of, the Vargas air vent.

BRIEF DESCRIPTION OF THE DRAWINGS

Embodiments are illustrated by way of example and not limited in the following figure(s), in which like numerals indicate like elements, in which.

DETAILED DESCRIPTION

For simplicity and illustrative purposes, the principles of the embodiments are described by referring mainly to examples thereof. In the following description, numerous specific details are set forth in order to provide a thorough understanding of the embodiments. It will be apparent however, to one of ordinary skill in the art, that the embodiments may be practiced without limitation to these specific details. In other instances, well known methods and structures are not described in detail so as not to unnecessarily obscure the description of the embodiments.

Disclosed herein is a self-powered flow control apparatus having one or more louvers configured to vary the flow of fluid through the flow control apparatus. The flow control apparatus also includes a fluid flow-driven electrical generator that is positioned substantially along the same plane as the one or more louvers within the flow control apparatus. In this regard, the electrical generator is able to continue to generate an output current even when the one or more louvers are in a fully closed position. As such, the flow control apparatus disclosed herein does not require an energy storage device. Instead, an energy storage device is optional and may be included, for instance, when faster motors are employed that require more energy than the amount that the fluid flow-driven electrical generator is able to generate at a given time.

All of the components of the self-powered flow control apparatus may be contained within the confines of casing walls of the flow control apparatus. In this regard, components may be protected from physical damage by the casing and a cover of the flow control apparatus.

The term "fluid," as used herein, refers to, for instance, a cooling resource (liquid or gas) for use in cooling heat generating devices, such as, electronic components in a data center. As such, for instance, the fluid may include cool airflow, refrigerant, water, etc. In addition, the flow of fluid disclosed herein may be adjusted in various manners to control the supply of fluid to the heat generating devices and/or heat removal devices, such as, air conditioning units. In one embodiment, the delivery of fluid may be adjusted through operation of flow control apparatuses having adjustable louvers or, equivalently, dampers.

Figure 1:
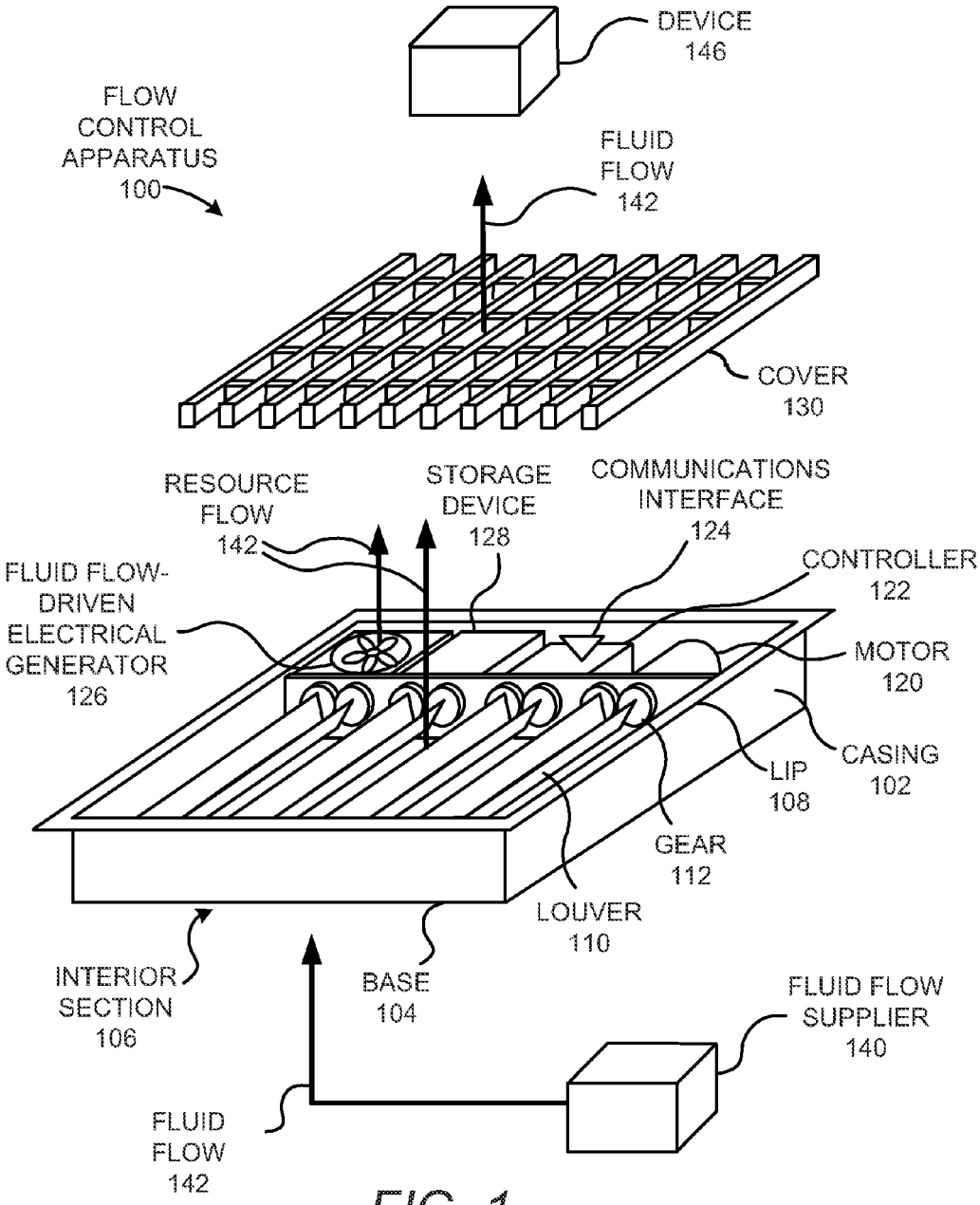
FIG. 1 illustrates a perspective view of a self-powered flow control apparatus, according to an embodiment of the invention.

With reference first to FIG. 1, there is shown a perspective view of a self-powered fluid control apparatus 100, according to an embodiment. It should be understood that the following description of the flow control apparatus 100 is but one manner of a variety of different manners in which such a flow control apparatus 100 may be configured. In addition, it should be understood that the flow control apparatus 100 may include additional components and that some of the components described herein may be removed and/or modified without departing from a scope of the flow control apparatus 100.

According to an embodiment, the flow control apparatus 100 comprises a vent tile sized to replace conventional floor tiles or vented floor tiles often employed in raised floors of data centers. The flow control apparatus 100 may, however be sized for various other applications, such as, on a ceiling, wall, or other location with respect to a duct. In any regard, the flow control apparatus 100 is configured to receive fluid flow 142 from one or more fluid flow suppliers 140. In addition, the fluid flow 142 from the fluid flow supplier(s) 140 are configured to flow through the fluid control apparatus 100 to one or more devices 146 positioned to be cooled by the fluid flow 142. The fluid flow supplier(s) 140 may comprise any suitable apparatus for supplying fluid flow to the device(s) 146, such as, air conditioning units, fans, blowers, heaters, etc. In addition, the device(s) 146 may comprise any device whose temperature may be affected by the fluid flow 142. By way of particular example, the device(s) 146 comprise servers or other computing equipment.

In any regard, the flow control apparatus 100 is depicted as being comprised of a casing 102 having a base 104 formed of a plurality of walls that define an open interior section 106. The casing 102 is also depicted as including a lip 108. The base 104 generally provides strength and rigidity to the flow control apparatus 100 and the lip 108 substantially maintains the flow control apparatus 100 in position with respect, for instance, to an opening in a raised floor over a pressurized plenum.

As further shown in FIG. 1, a plurality of louvers 110 attached to respective gears 112 are positioned within the interior section 106. The louvers 110 are rotatably connected to the base 104 through any suitable mechanisms. In addition, the gears 112 are connected to a motor 120 configured to rotate one or more of the gears 112. In this regard, the rotation of the gears 112 controllably varies a rotational position of the louvers 110, which varies the resistance to flow of the fluid through openings between the louvers 110. The gears 112, although not explicitly shown, may include teeth or cogs configured to mesh with neighboring gears 112 to enable rotational force applied to one of the gears 112 to be transmitted to the neighboring gears 112.

The motor 120 is configured to receive a drive signal from a controller 122, which may comprise, for instance, a control circuit, a microprocessor, an application specific integrated chip (ASIC), etc. The controller 122 may also receive input from a position detector (not shown) configured to track the positions of the louvers 110.

The flow control apparatus 100 comprises a self-powered apparatus. In other words, the power required to operate the controller 122 and the motor 120 is provided through generation of electrical energy on the flow control apparatus 100 itself. The electrical energy is generated through operation of a flow-driven electrical generator 126 that is positioned within the interior section 106 of the casing 102. In operation, the flow-driven electrical generator 126 is configured to generate an output current when sufficiently driven by a fluid flow stream 142 flow through the generator 126. The output current may be fed directly to the controller 122 and the motor 120 and/or to an optional storage device 128, such as a capacitor or battery configured to store the current produced by the generator 126. In this regard, the motor 120 and the controller 122 may receive the current directly from the generator 126 alone, directly from the storage device 128 alone, or from both the generator 126 and the storage device 128.

The fluid flow-driven electrical generator 126 is positioned substantially in the same plane as the louvers 110. In this regard, fluid flow 142 is configured to flow through the fluid flow-driven electrical generator 126 even when the louvers 110 are positioned to substantially block the flow of fluid therethrough. The storage device 128 is thus optional and may be provided in the flow control apparatus 100, for instance, when the motor 120 is designed to consume a greater amount of electrical current than the electrical generator 126 is able to generate at a given time.

In addition, the motor 120, the controller 122, and the storage device 128 have been depicted as being contained within the interior section 106 of the casing 102 substantially along the same plane as the louvers 110. In this regard, the motor, the controller 122, the fluid flow-driven electrical generator 126, and the storage device 128 are protected within the casing 102 of the flow control apparatus 100. In addition, these components are further protected by a cover 130 that is formed of a grated structure having a plurality of openings through which the fluid flow 142 may readily pass. The cover 130 generally protects the louvers 110 and other components 120-128 contained in the flow control apparatus 100 as personnel walk over, or equipment is moved over, the flow control apparatus 100. Although the cover 124 has been depicted as forming a separate component from the casing 102, it should be understood that the cover 130 may be integrated with the casing 102 without departing from a scope of the flow control apparatus 100.

Figure 2:
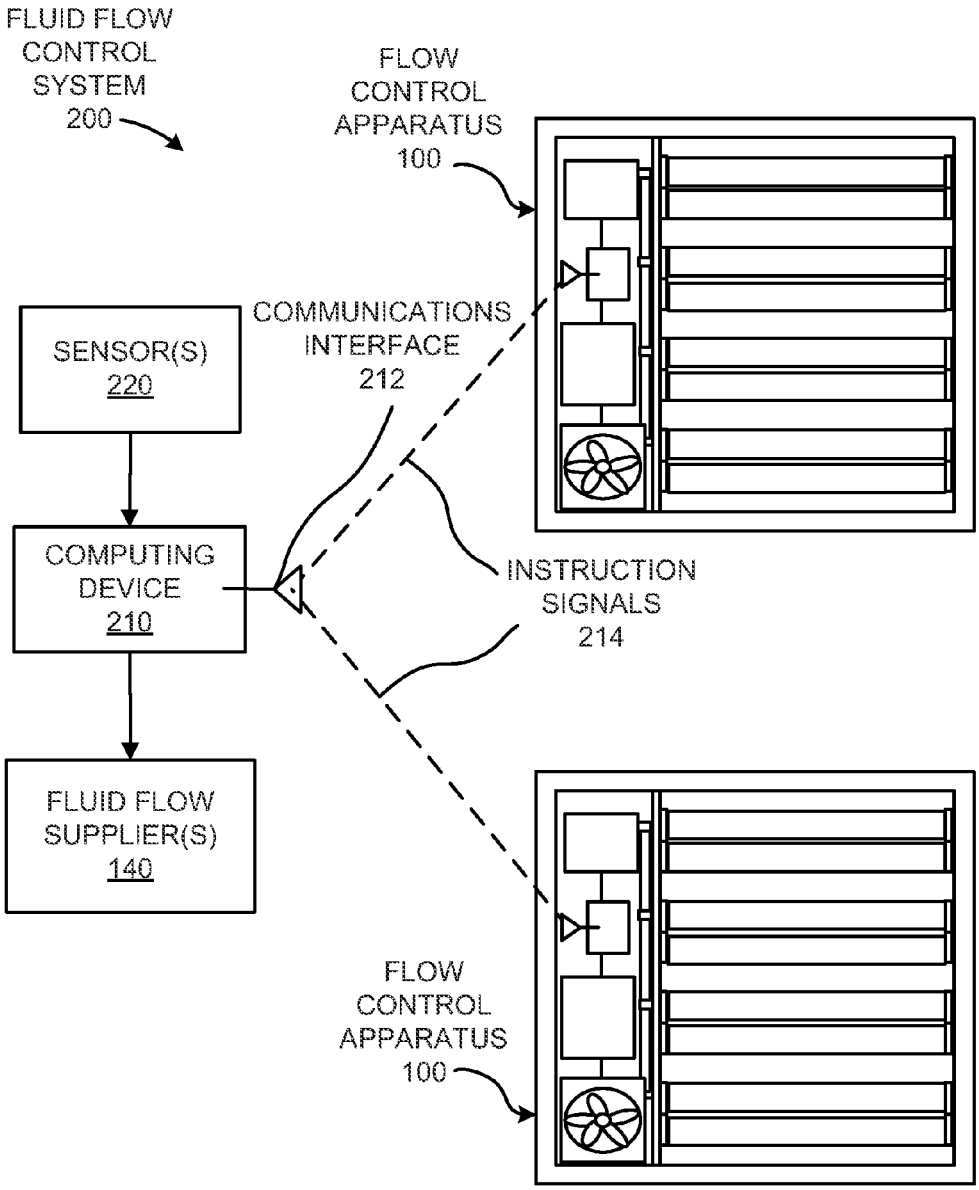
FIG. 2 illustrates a block diagram of a fluid flow control system, according to an embodiment of the invention.

Turning now to FIG. 2, there is shown block diagram of a fluid flow control system 200, according to an example. It should be understood that the following description of the fluid flow control system 200 is but one manner of a variety of different manners in which such a fluid flow control system 200 may be configured.

As shown therein, the fluid flow control system 200 includes a computing device 210, one or more sensors 220, and a plurality of the flow control apparatuses 100 depicted in FIG. 1. It should be understood that the fluid flow control system 200 may include additional components and that some of the components described herein may be removed and/or modified without departing from a scope of the fluid flow control system 200. For instance, the fluid flow control system 200 may include any number of flow control apparatuses 100.

The sensor(s) 220 may comprise any of various types of sensors configured to detect one or more environmental conditions, such as, temperature, pressure, mass flow rate, etc. In addition, or alternatively, the sensor(s) 220 may comprise sensors used to calibrate the positions of the louvers 110 with respect to the mass flow rate of fluid flow 142 supplied through the flow control apparatus 100. By way of example, these sensors may include a flow hood sensor (not shown) positioned to detect the mass flow rate of fluid flow 142, such as air, flowing through the flow control apparatus 100 at various louver 110 settings. In addition, the sensor(s) 220 may be positioned at any of various locations with respect to the flow control apparatus 100, such as, at an inlet or outlet of the flow control apparatus 100, at an inlet, outlet or interior location of the device 146, such as, a rack or server, etc.

In any regard, the sensor(s) 220 are configured to communicate, either wirelessly or through a wired connection, the detected environmental conditions to the computing device 210. The computing device 210 may comprise any suitable device for receiving and processing data, such as, a server, a personal computer, a laptop computer, a personal digital assistant (PDA), a cellular telephone, etc. in addition, the computing device 210 comprises software and/or hardware configured to process the environmental conditions detected by the sensor(s) 220 to determine how the fluid is to flow through one or more of the flow control apparatuses 100. Thus, for instance, if the computing device 210 determines that a temperature measurement at a location that receives fluid flow 142 from a particular flow control apparatus 100 is above a predetermined threshold temperature, the computing device 210 may determine that the flow rate of fluid flow 142 through that flow control apparatus 100 is to be increased.

In addition, the computing device 210 is equipped with a communications interface 212 through which the computing device 210 is configured to wirelessly communicate instruction signals 214 to the flow control apparatuses 100. The communications interface 212 may enable the wireless communication through implementation of any suitable wireless protocol, such as, 802.11, Bluetooth, infrared, RF, etc. The flow control apparatuses 100, and more particularly, the controllers 122, are configured to communicate control signals to the motors 120 to vary the positions of the louvers 110 based upon the instruction signals received from the computing device 210. In addition, the controllers 122 may be configured to communicate data back to the computing device 210 pertaining to, for instance, the positions of the louvers 110, conditions detected by sensors (not shown) on the flow control apparatuses 100, etc., through the wireless communication between the communications interfaces 124, 212 of the flow control apparatuses 100 and the computing device 210. In this regard, the controllers 122 of the flow control apparatuses 100 may be configured to wirelessly communicate with the computing device 210 and thus, the flow control apparatuses 100 need not be wired to the computing device 210 for the controller 122 to receive and/or transmit data.

According to an example, the computing device 210 is also configured to communicate instruction signals to one or more fluid flow suppliers 140, to for instance, control the temperature and/or flow rate of fluid flow 142 supplied by the fluid flow supplier(s) 140.

Figure 3:
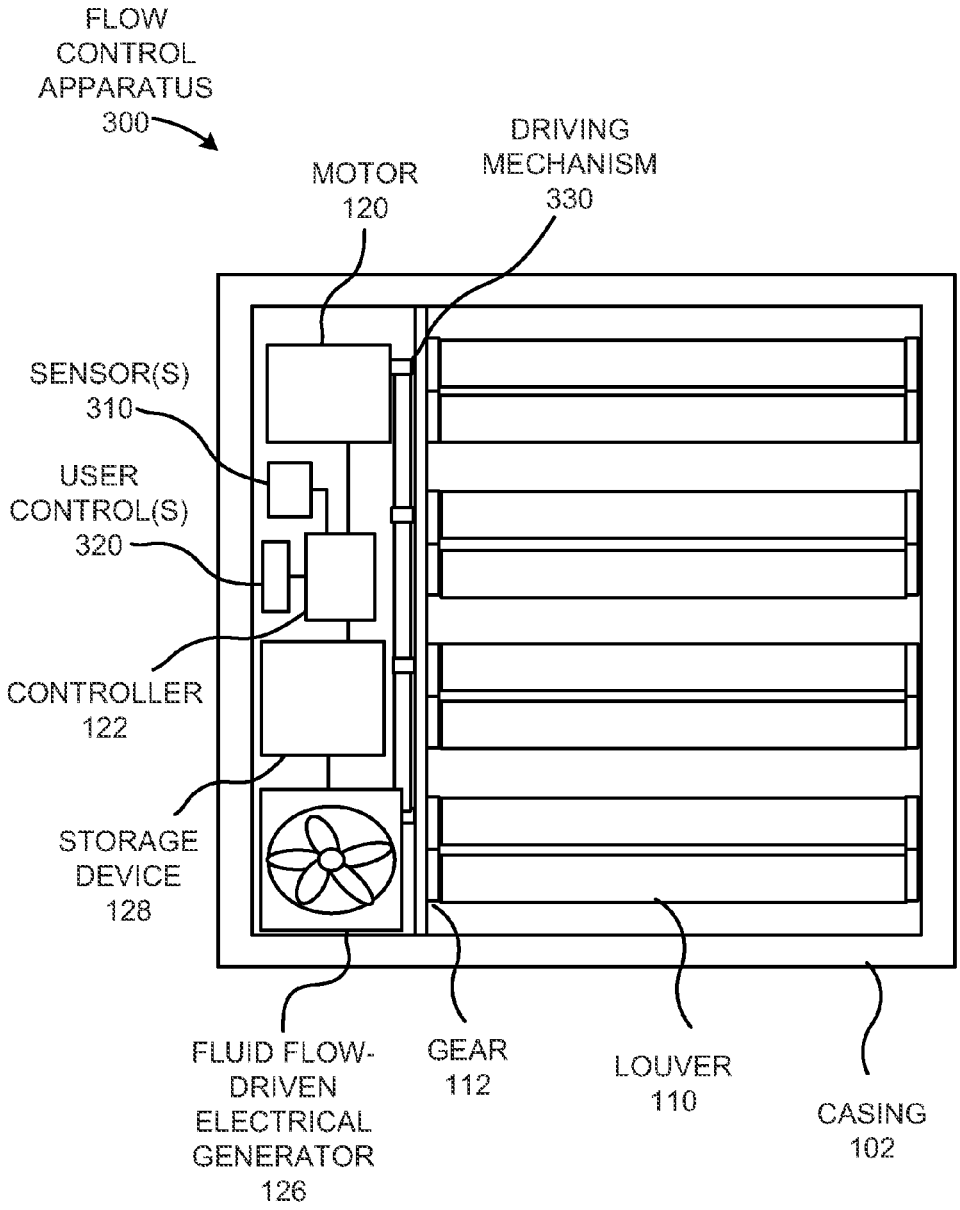
FIG. 3 illustrates a top view of a self-powered flow control apparatus, according to another embodiment of the invention.

Turning now to FIG. 3, there is shown a top view of a self-powered flow control apparatus 300, according to another embodiment. It should be understood that the following description of the flow control apparatus 300 depicted in FIG. 3 is but one manner of a variety of different manners in which such a flow control apparatus 300 may be configured.

Generally speaking, the flow control apparatus 300 is configured to operate autonomously. In this regard, in addition to the features that are common with the flow control apparatus 100 depicted in FIG. 1, the flow control apparatus 300 includes one or more sensors 310 and user controls 320. Thus, for instance, a user may set a desired operating characteristic, such as, desired temperature or mass flow rate, through interaction with the user control 320. In addition, the controller 122 may receive condition(s) detected by the sensor(s) 310 and may determine whether the desired operating characteristic is being met. If the controller 122 determines that the desired operating characteristic is not being met, the controller 122 may determine how the motor 120 is to be operated to meet the desired operating characteristic. In addition, the controller 122 may communicate control signals to the motor 120 to be operated according to the determined operation.

Also shown in FIG. 3 is a driving mechanism 330, which is connected to the motor 120 and the gears 112. In one example, the driving mechanism 330 may comprise a belt configured to be rotated by the motor 120 and to cause the gears 112 to be rotated. The driving mechanism 330 may, however, comprise any other suitable mechanisms through which the louvers 110 may be rotated by the motor 120.

Figure 4:
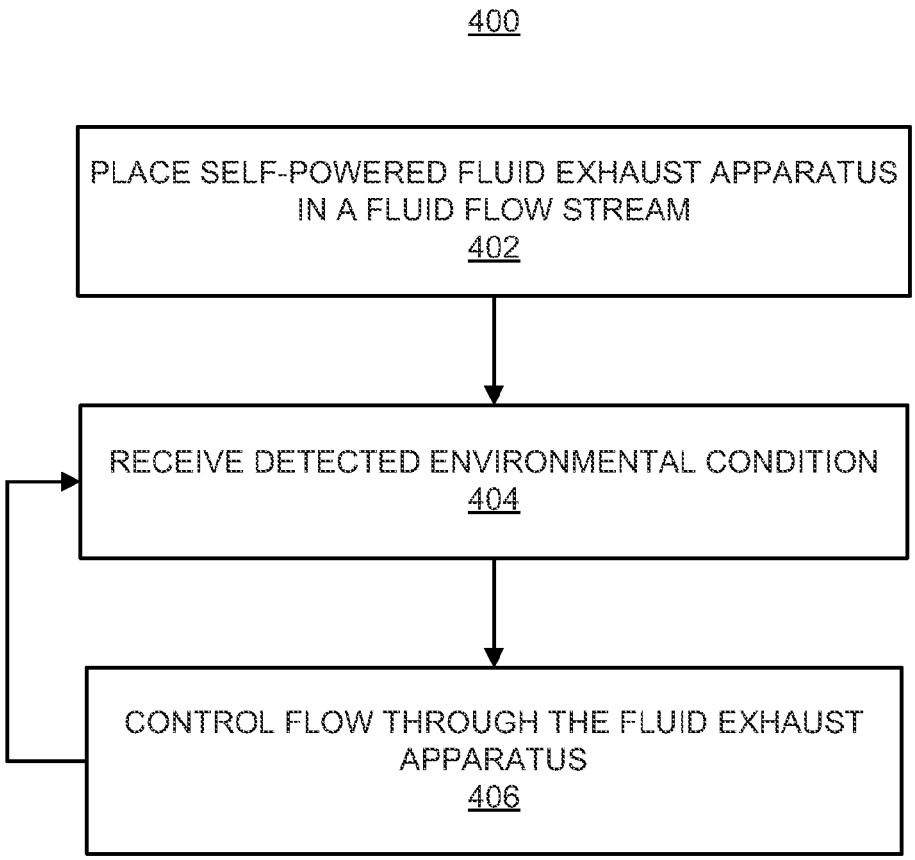
FIG. 4, depicts a flow diagram of a method of controlling fluid flow through a self-powered flow control apparatus, according to an embodiment of the invention.

Various manners in which fluid flow may be controlled through a flow control apparatus 100, 300 are discussed in greater detail herein below with respect to the method 400 depicted in FIG. 4. FIG. 4, more particularly, depicts a flow diagram of a method 400 of controlling fluid flow through at least one flow control apparatus 100, 300, according to an embodiment of the invention. It should be understood that the method 400 may include additional steps and that some of the steps described herein may be removed and/or modified without departing from a scope of the method 400.

At step 402, at least one self-powered flow control apparatus 100, 300 is placed in a fluid flow stream. Thus, for instance, the flow control apparatus 100, 300 may be placed in an opening of a raised floor above a pressurized plenum, in a lowered ceiling beneath a duct through which the fluid flows out of a room, etc.

At step 404, a detected environmental condition is received. According to a first example in which the flow control apparatus 100 is configured to receive instruction signals from a computing device 210 as discussed above with respect to FIG. 2, the computing device 210 is configured to receive the detected environmental condition information from the sensor(s) 220. In another example in which the flow control apparatus 300 is configured to operate autonomously as discussed above with respect to FIG. 3, the controller 122 is configured to receive the detected environmental condition information from the sensor(s) 310. The environmental conditions detected by the sensor(s) 310 may also be communicated to the computing device 210 as discussed above.

At step 406, the controller 122 is configured to control fluid flow 142 through the flow control apparatus 100, 300 based upon the detected environmental condition. More particularly, for instance, the controller 122 is configured to determine how the motor 120 is to be operated to vary the fluid flow 142 through the flow control apparatus 100, 300 to, for instance, meet a predetermined requirement. By way of particular example, the controller 122 may determine that the temperature at a particular location exceeds the predetermined requirement and may thus determine that the fluid flow through the flow control apparatus 100, 300 is to be increased. In addition, the controller 122 is configured to transmit control signals to the motor 120 to vary the positions of the louvers 110 to cause the fluid flow 142 through the flow control apparatus 100, 300 to be varied as determined to meet the predetermined requirement.

In addition, steps 404 and 406 may be continuously performed to continuously control flow of the fluid through the flow control apparatus 100, 300, for instance, as environmental conditions change.

Some or all of the operations set forth in the method 400 may be contained as one or more utilities, programs, or subprograms, in any desired computer accessible or readable medium. In addition, the method 400 may be embodied by a computer program, which may exist in a variety of forms both active and inactive. For example, they may exist as software program(s) comprised of program instructions in source code, object code, executable code or other formats. Any of the above may be embodied on one or more computer readable storage devices or media.

Exemplary computer readable storage devices include conventional computer system RAM, ROM, EPROM, EEPROM, and magnetic or optical disks or tapes. Concrete examples of the foregoing include distribution of the programs on a CD ROM or via Internet download. It is therefore to be understood that any electronic device capable of executing the above-described functions may perform those functions enumerated above.

What has been described and illustrated herein is an embodiment along with some of its variations. The terms, descriptions and figures used herein are set forth by way of illustration only and are not meant as limitations. Those skilled in the art will recognize that many variations are possible within the spirit and scope of the subject matter, which is intended to be defined by the following claims—and their equivalents—in which all terms are meant in their broadest reasonable sense unless otherwise indicated.

What is claimed is:

1. A self-powered flow control apparatus, said flow control apparatus comprising:

a casing having an interior section defined by a plurality of walls, wherein said casing is to be positioned within a fluid flow stream the casing having a divider to create paths of fluid flow;

at least one louver positioned within the interior section, wherein the at least one louver is rotatable about an axis, said axis extending along a plane that is perpendicular to a direction of flow of the fluid flow stream;

a fluid flow-driven electrical generator having a rotating element positioned within the interior section substantially along the plane such that the at least one louver and the rotating element are in different ones of the paths of fluid flow through the interior section of the casing, wherein said fluid flow-driven electrical generator is to generate an output current when the rotating element is sufficiently driven by a fluid flow stream flow through the generator;

a motor coupled to the at least one louver, wherein said motor is to vary a position of the at least one louver to change a resistance to flow of the fluid through the interior section in response to receipt of a control signal; and a controller to generate and provide the control signal to the motor.

2. The self-powered flow control apparatus according to claim 1, further comprising:

an energy storage device to receive and store the output current generated by the fluid flow-driven electrical generator; and wherein the motor and the controller are to be powered solely by at least one of the output current generated by the fluid flow-driven electrical generator and the output current received and stored in the energy storage device.

3. The self-powered flow control apparatus according to claim 2, wherein the energy storage device is positioned within the interior section.

4. The self-powered flow control apparatus according to claim 2, wherein the motor, the controller and the energy storage device are positioned within the interior section of the casing.

5. The self-powered flow control apparatus according to claim 4, wherein the interior section comprises a first area and a second area, and wherein the first area includes an opening and the at least one louver, wherein the at least one louver is to change the resistance to flow of the fluid through the opening and wherein the motor, the controller, and the energy storage device are positioned within the second area.

6. The self-powered flow control apparatus according to claim 4, wherein the motor, the controller and the energy storage device are positioned substantially along the plane of the at least one louver.

7. The self-powered flow control apparatus according to claim 1, wherein the plurality of walls extend between a lower plane and an upper plane, and wherein the interior section is contained within the lower plane and the upper plane of the plurality of walls.

8. The self-powered flow control apparatus according to claim 1, further comprising:

a grated cover to cover the interior section of the casing.

9. The self-powered flow control apparatus according to claim 1, further comprising:

a wireless communication interface; and wherein the controller is to at least one of wirelessly receive instructions through the wireless communication interface to adjust the position of the at least one louver to thereby vary the mass flow rate of fluid flow through the flow control apparatus and to wirelessly communicate data to a computing device.

10. The self-powered flow control apparatus according to claim 1, further comprising:

a user control to receive user instructions pertaining to a desired characteristic of the fluid flow through the flow control apparatus;

a sensor to detect at least one environmental condition; and wherein the controller is to determine how the motor is to be controlled to meet the desired characteristic based upon the detected at least one environmental condition and to generate and provide the determined control to the motor.

11. A fluid flow control system comprising one or more self-powered flow control apparatuses, each of said one of more self-powered flow control apparatuses comprising:

a casing having an interior section defined by a plurality of walls, said interior section comprising an opening, wherein said casing is to be positioned within a fluid flow stream the casing having a divider to create paths of fluid flow;

at least one louver positioned within the opening, said at least one louver being rotatable about an axis, said axis extending along a plane that is perpendicular to a direction of flow of the fluid flow stream;

a fluid flow-driven electrical generator having a rotating element positioned within the opening substantially along the plane such that the at least one louver and the rotating element are in different ones of the paths of fluid flow through the interior section of the casing, wherein said fluid flow-driven electrical generator is to generate an output current when the rotating element is sufficiently driven by a fluid flow stream through the interior section;

a motor coupled to the at least one louver, wherein said motor is to vary a position of the at least one louver to change a resistance to flow of the fluid through the casing in response to receipt of a control signal;

a controller to generate and provide the control signal; and a computing device to wirelessly communicate instruction signals to the controllers of the one or more self-powered flow control apparatuses.

12. The fluid flow control system according to claim 11, each of said one of more self-powered flow control apparatuses further comprising:

an energy storage device to receive and store the output current generated by the fluid flow-driven electrical generator; and wherein the motor and the controller are to be powered solely by at least one of the output current generated by the fluid flow-driven electrical generator and the output current received and stored in the energy storage device.

13. The fluid flow control system according to claim 12, wherein the motor, the controller and the energy storage device of each of the one or more self-powered flow control apparatuses are positioned within the interior section of the casing substantially along the plane of the at least one louver.

14. The fluid flow control system according to claim 11, said system further comprising:

at least one sensor to detect at least one environmental condition;

wherein the computing device is to receive the detected at least one environmental condition and to generate the instruction signals based upon the received at least one environmental condition.

15. The fluid flow control system according to claim 14, wherein the at least one sensor is positioned on at least one of the flow control apparatuses, and wherein the computing device is to receive the detected at least one environmental condition from the at least one sensor.

16. The fluid flow control system according to claim 11, wherein the plurality of walls of each of the one or more self-powered flow control apparatuses extend between a lower plane and an upper plane, and wherein the interior section is contained within the lower plane and the upper plane of the plurality of walls.

17. A method for controlling fluid flow through a self-powered flow control apparatus, said method comprising:

placing the self-powered flow control apparatus in a fluid flow stream, wherein the self-powered flow control apparatus comprises a casing having an interior section defined by a plurality of walls the casing having a divider to create paths of fluid flow, at least one louver positioned within the interior section, wherein the at least one louver is rotatable about an axis, said axis extending along a plane that is perpendicular to a direction of flow of the fluid flow stream, a fluid flow-driven electrical generator having a rotating element positioned within the interior section along a common plane as the at least one louver such that the at least one louver and the rotating elements are in different ones of the paths of fluid flow through the interior section of the casing, wherein said fluid flow-driven electrical generator is to generate an output current when the rotating element is sufficiently driven by the fluid flow stream through the generator, the self-powered flow control apparatus further comprising a motor coupled to the at least one louver, and a controller to generate and provide a control signal to the motor;

receiving a detected environmental condition; and controlling the flow fluid through the flow control apparatus based upon the detected environmental condition.

18. The method according to claim 17, further comprising:

analyzing the detected environmental condition in the controller of the flow control apparatus to determine how the at least one louver is to be controlled by the motor.

19. The method according to claim 18, further comprising:

receiving an instruction input from a user; and wherein analyzing the detected environmental condition further comprises analyzing the detected environmental condition to determine how the at least one louver is to be controlled by the motor to meet a requirement of the instruction input.

20. The method according to claim 17, further comprising:

analyzing the detected environmental condition in a computing device that is separate from the controller of the flow control apparatus to determine how the fluid flow through the flow control apparatus is to be controlled in the computing device; and wirelessly receiving an instruction signal pertaining to the determined control by the controller of the flow control apparatus, wherein the controller is configured to generate and provide a control signal to the motor based upon the instruction signal.

* * * * *